US007204483B2

(12) United States Patent
Mo et al.

(10) Patent No.: US 7,204,483 B2
(45) Date of Patent: Apr. 17, 2007

(54) SHEET MEDIA INPUT TRAY

(75) Inventors: Jiangxiao Mo, Vancouver, WA (US); Kelly A. Brock, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 332 days.

(21) Appl. No.: 10/431,920

(22) Filed: May 8, 2003

(65) Prior Publication Data

US 2004/0245707 A1 Dec. 9, 2004

(51) Int. Cl.
*B65H 1/00* (2006.01)

(52) U.S. Cl. ..... 271/161; 271/167

(58) Field of Classification Search ..... 271/161, 271/167, 117

See application file for complete search history.

(56) References Cited

U.S. PATENT DOCUMENTS 3,687,448 A * 8/1972 Vora ..... 271/21
5,050,853 A * 9/1991 LaVos et al. ..... 271/98
5,356,229 A 10/1994 Hickman
5,722,652 A * 3/1998 Yoshida et al. ..... 271/11
5,820,283 A 10/1998 Sunada
2003/0184003 A1* 10/2003 Asada et al. ..... 271/121

FOREIGN PATENT DOCUMENTS

JP 07-009713 1/1995
JP 07-256955 10/1995
JP 08-300641 11/1996

* cited by examiner

*Primary Examiner*—Patrick Mackey
*Assistant Examiner*—Kaitlin Joerger

(57) ABSTRACT

In one embodiment, a sheet media input tray comprises a base and opposing sidewalls. The base includes a first feature configured to support sheet media lying flat in the tray and a second feature intersecting the first feature across the width of the tray. The intersection between the first feature and the second feature defines an elongated fulcrum along which media sheets can bend when pressed against the base. In another embodiment, a sheet media input tray comprises a first elevated sheet supporting surface, a depressed portion immediately adjacent to and downstream from the first sheet supporting surface, and a second elevated sheet supporting surface immediately adjacent to and downstream from the depressed portion. The depressed portion spans the full width of sheet media that may be supported in the tray and the second sheet supporting surface lies in the same plane as the first sheet supporting surface.

11 Claims, 14 Drawing Sheets

SHEET MEDIA INPUT TRAY

FIELD OF THE INVENTION

The invention relates to an input tray for printers and other sheet media processing devices.

BACKGROUND

A swing arm type pick mechanism is used in some printers to feed sheets of paper or other print media into the printer. In a swing arm type pick mechanism, the feed roller is mounted to the end of a swing arm that pivots or "swings" above the media input tray. The pick roller rests on top of the stack of media sheets in the tray. A biasing spring applies a small force urging the swing arm down to keep the pick roller in contact with the top of the stack as sheets are used and the stack gets smaller. The swing arm pivot is located upstream (rearward) from the pick roller so that the pick roller will pull itself into the stack as it picks the top sheet and feeds it into the printer, rather than push itself away from the stack. The swing arm provides the force pressing down against the stack to create friction between the pick roller and the top sheet in the stack. The friction helps the pick roller grip the top sheet and move it off the stack. This pressing force is often called a "normal" force because the direction of the force is normal (perpendicular) to the stack. The rotating pick roller, by contrast, provides a force directed along the top sheet to move the sheet forward off the stack.

One advantage of a swing arm type pick mechanism is the self-adjusting relationship between the pick load and the pick force. The swing arm pivot above and behind the pick roller allows the pick force exerted by the pick roller to increase automatically as the pick load (the top sheet's resistance to movement) increases. For example, heavier media increases the top sheet's resistance to movement. Heavy media, therefore, creates a higher pick load. Consequently, a larger pick force is necessary to move the top sheet off the stack. As the pick load increases, however, the force of the pick roller against the unmoving top sheet drives the swing arm down and presses the pick roller harder against the stack, increasing the normal force, to automatically increase the pick force. This effect becomes more pronounced as the stack gets smaller. Unfortunately, as the pick roller presses harder against the stack, the friction between the sheets increases which, in turn, increases the pick load. The increased pick load negates some of the self-adjusting effect of the swing arm pick mechanism.

The present invention was developed in an effort to reduce the pick load in a swing arm type mechanism, particularly for heavy, stiff and other higher friction print media.

DETAILED DESCRIPTION

Embodiments of the invention will be described with reference to the inkjet printer shown in FIGS. 1 and 2. The invention, however, is not limited to use with inkjet printers. Embodiments of the invention may be implemented in any printer or other sheet media processing device in which it is necessary or desirable to reduce the pick load of media sheets picked from the sheet input tray. While the invention is not limited to use with inkjet printers, it is expected that various embodiments of the invention will be particularly useful in printers with a U-shaped media path typical of many inkjet printers in which the print media is fed at a steep angle from a horizontal tray.

Figure 1:
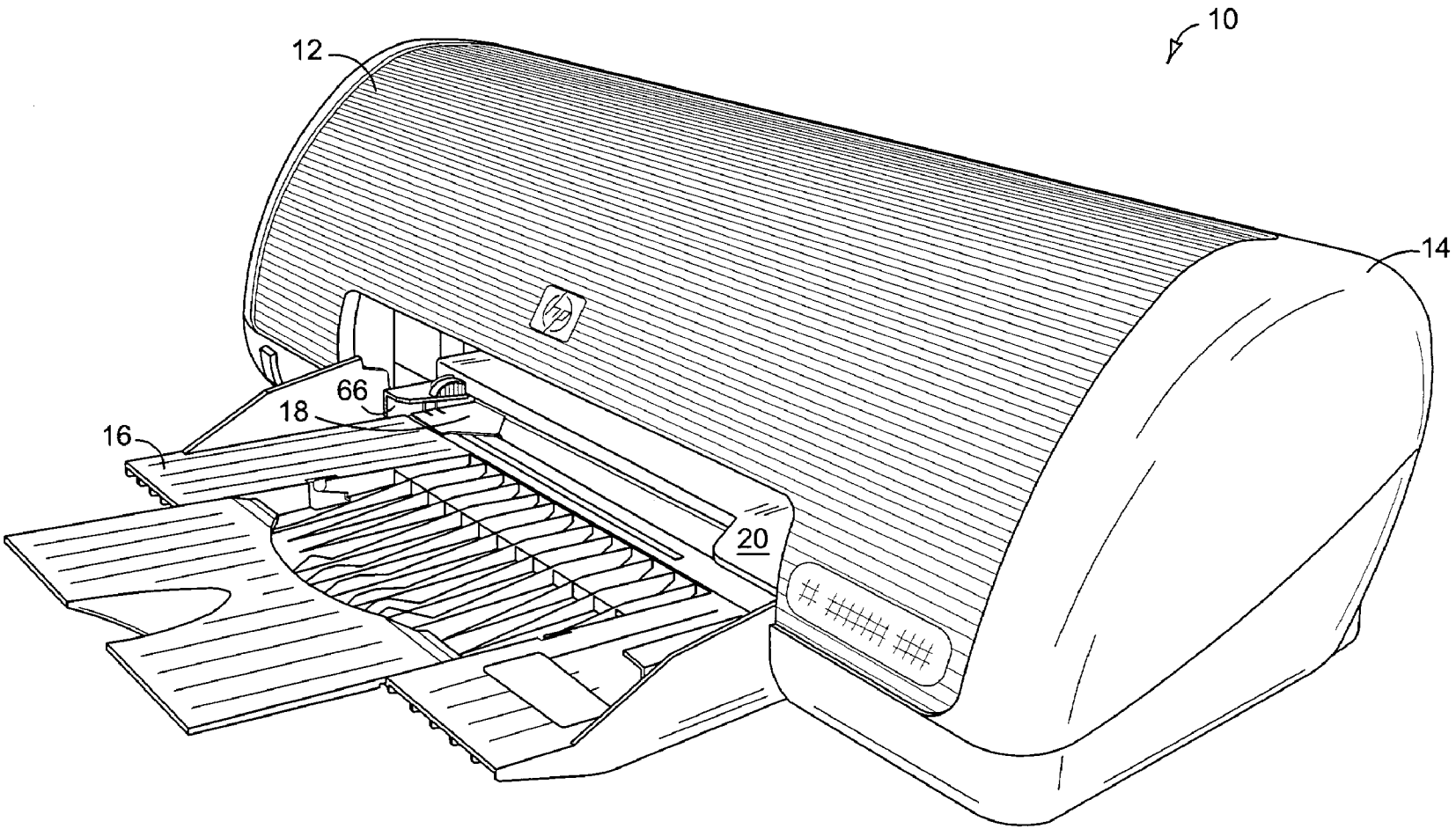
FIG. 1 is a perspective view of an inkjet printer.

FIG. 1 illustrates an inkjet printer 10. FIG. 2 shows inkjet printer 10 with cover 12 (FIG. 1) and other parts of housing 14 removed. FIG. 3 is a side elevation and partial section view of an inkjet printer 10 such as the one shown in FIGS. 1 and 2 with a conventional sheet media tray 16 (FIG. 2). A conventional sheet media tray is discussed first along with the other components of printer 10 to better distinguish the various embodiments of the sheet media tray of the present invention. FIGS. 3–7 show a conventional tray. FIGS. 8–13 show a new tray.

Figure 2:
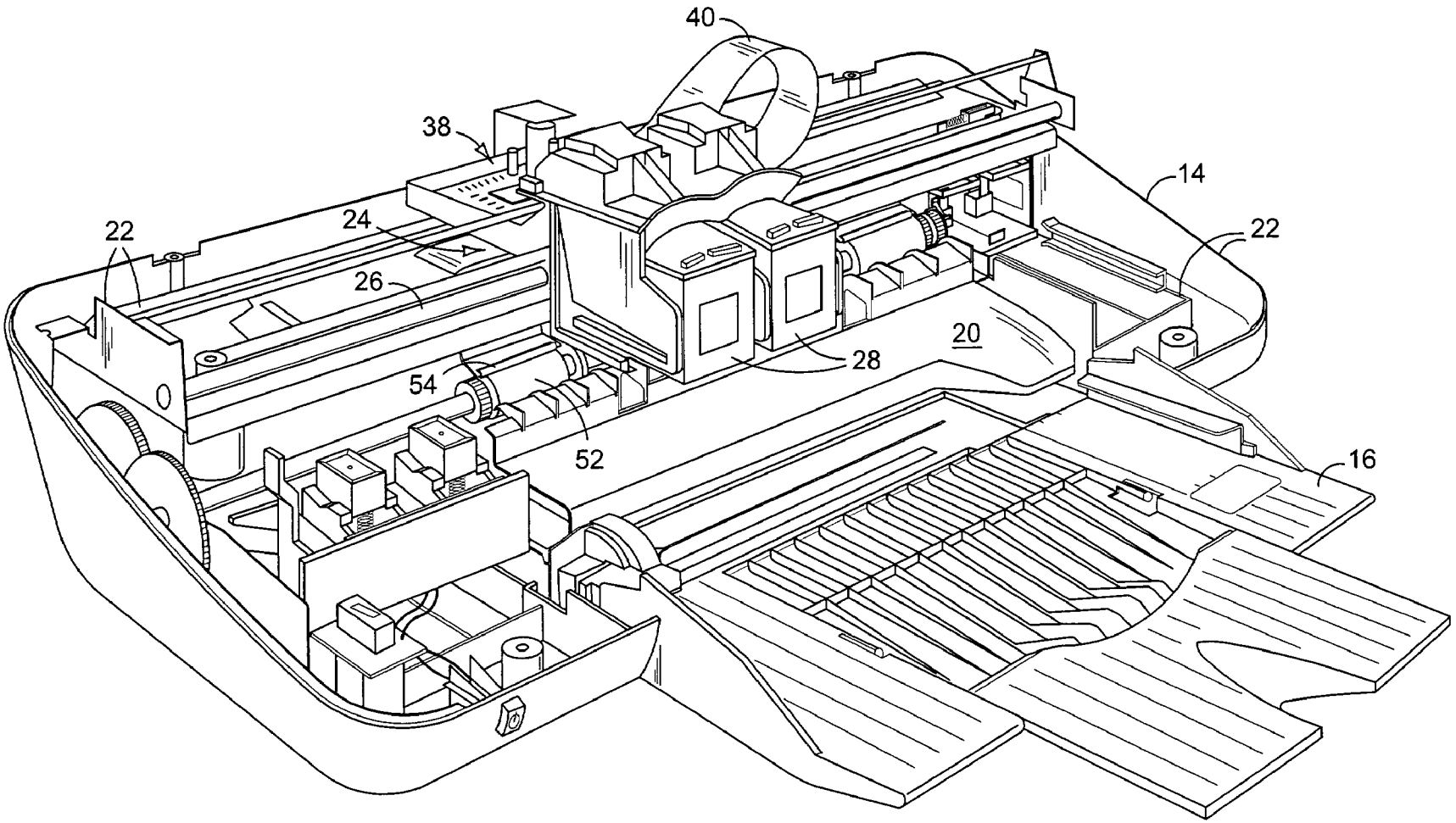
FIG. 2 is a perspective view of an inkjet printer such as the one shown in FIG. 1 with the cover and other parts of the housing removed.
Figure 3:
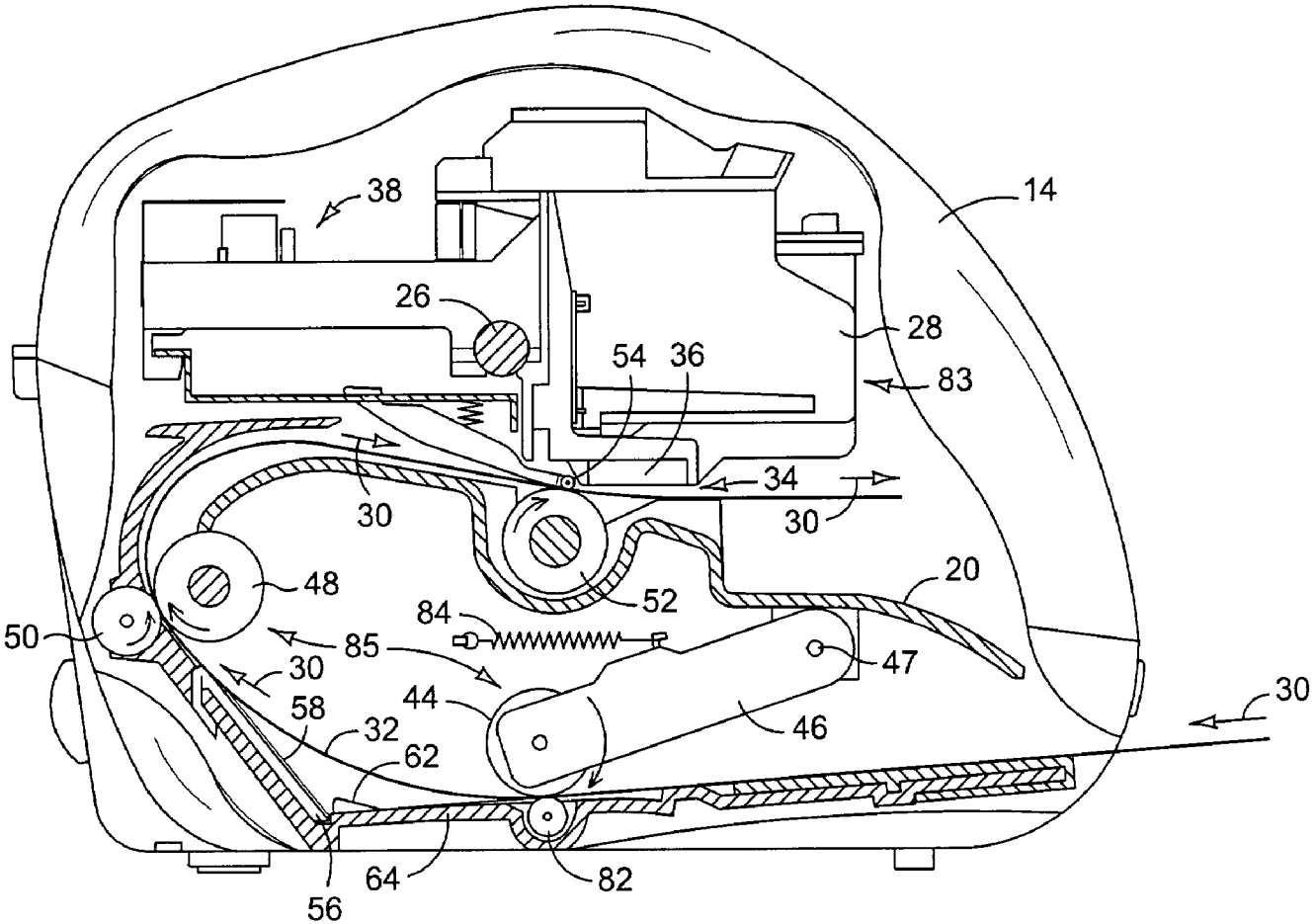
FIG. 3 (Prior Art)
FIG. 3 is a side elevation and partial section view of an inkjet printer such as the one shown in FIG. 2 with a conventional media tray and pick mechanism.

Referring to FIGS. 1–3, printer 10 includes a cover 12 and a housing 14. A sheet media tray 16 is positioned at the bottom of printer 10 along an opening 18 in housing 14. Paper or other print media sheets 32 (FIG. 3) are stacked in tray 16 for input to printer 10 and printed sheets are output back through opening 18 over tray 16. A supporting surface 20 helps suspend the trailing edge of the printed sheets over tray 16.

Printer 10 includes a chassis 22 that supports the operative components of printer 10. Chassis 22 represents generally those parts of housing 14 along with other structurally stable elements in printer 10 that support the operative components of printer 10. A printhead carriage 24 is driven back and forth along a guide rail 26 mounted to chassis 22. Any suitable drive mechanism may be used to move carriage 24. A reversing motor (not shown) coupled to carriage 24 through a belt and pulley system (not shown), for example, is one carriage drive mechanism commonly used in inkjet printers.

Carriage 24 has stalls for holding one or more printheads 28. In the printer shown in FIGS. 1–3, carriage 24 carries two printheads 28—one printhead containing color ink for color printing and one printhead containing black ink for monochrome printing. Printheads 28 are also commonly referred to as print cartridges or ink cartridges. As best seen in FIG. 3, printheads 28 are positioned along media path 30 such that each sheet of print media 32 passes directly under printheads 28 at print zone 34. The bottom 36 of each printhead 28, which faces media sheet 32, includes an array of nozzles through which drops of ink are ejected onto media sheet 32.

An electronic printer controller 38 receives print data from a computer, scanner, digital camera or other image generating device. Controller 38 controls the movement of carriage 24 back and forth across media sheet 32 and the advance of media sheet 32 along media path 30. Printer controller 38 is also electrically connected to printheads 28 through, for example, a flexible ribbon cable 40. As carriage 24 carries printheads 28 across media sheet 32, printer controller 38 selectively activates ink ejection elements in printheads 28 according to the print data to eject ink drops through the nozzles onto media sheet 32. By combining the movement of carriage 24 across media sheet 32 with the movement of sheet 32 along media path 30, controller 38 causes printheads 28 to eject ink onto media sheet 32 to form the desired print image.

Figure 4:
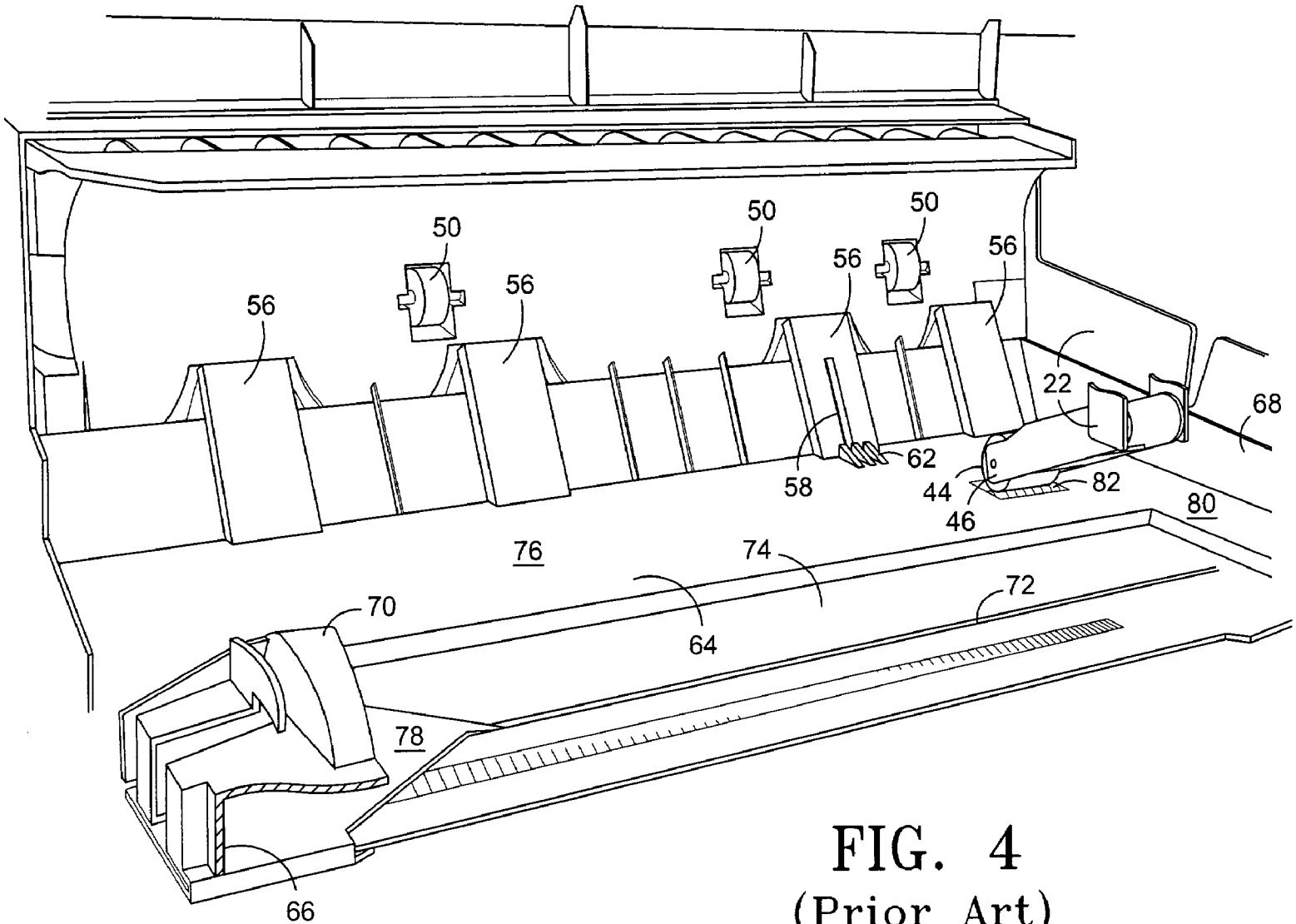
FIG. 4 (Prior Art)
FIG. 4 is a perspective view showing in more detail the media tray and pick mechanism of the printer of FIG. 3.
Figure 5:
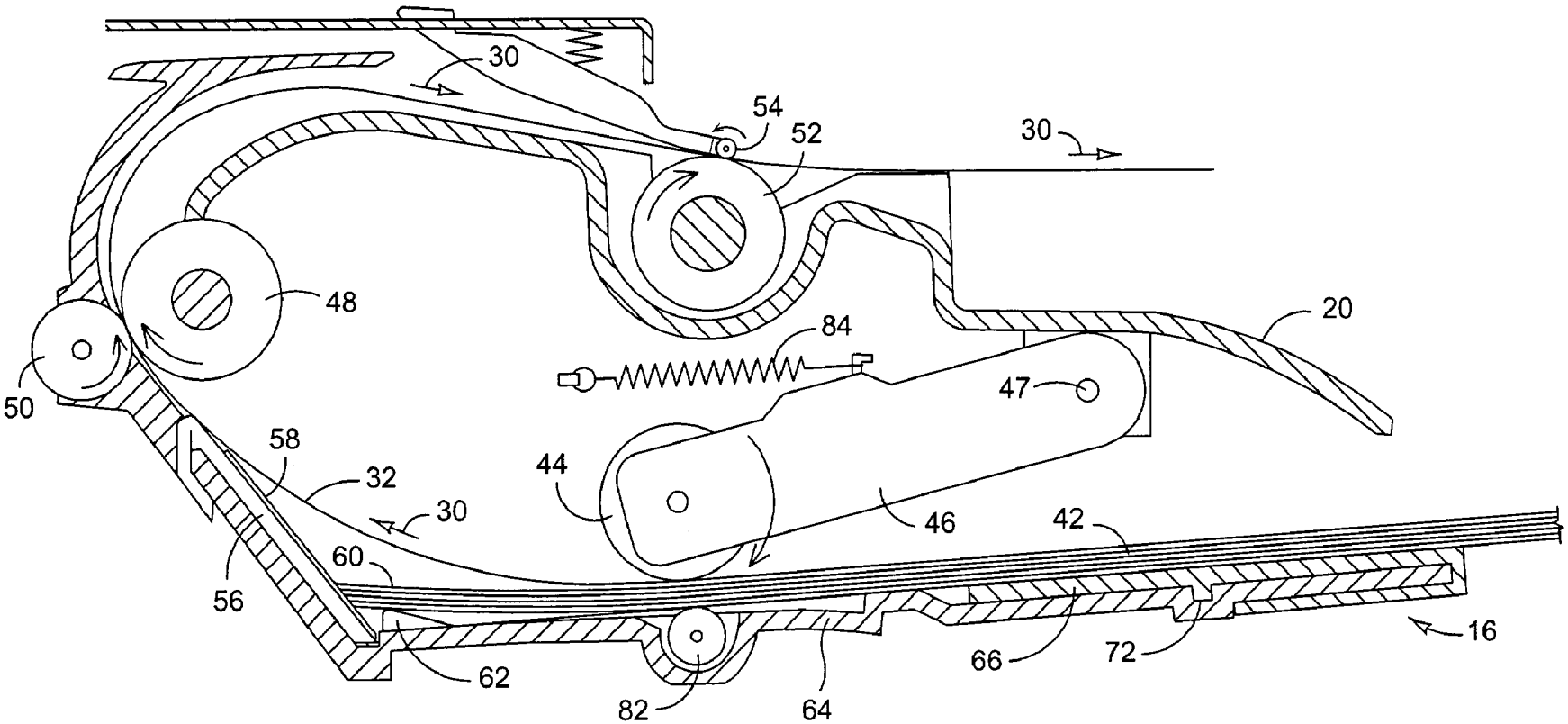
FIG. 5 (Prior Art)
FIGS. 5 and 6 are side elevation and partial section views of the media tray and pick mechanism of FIG. 4.
Figure 6:
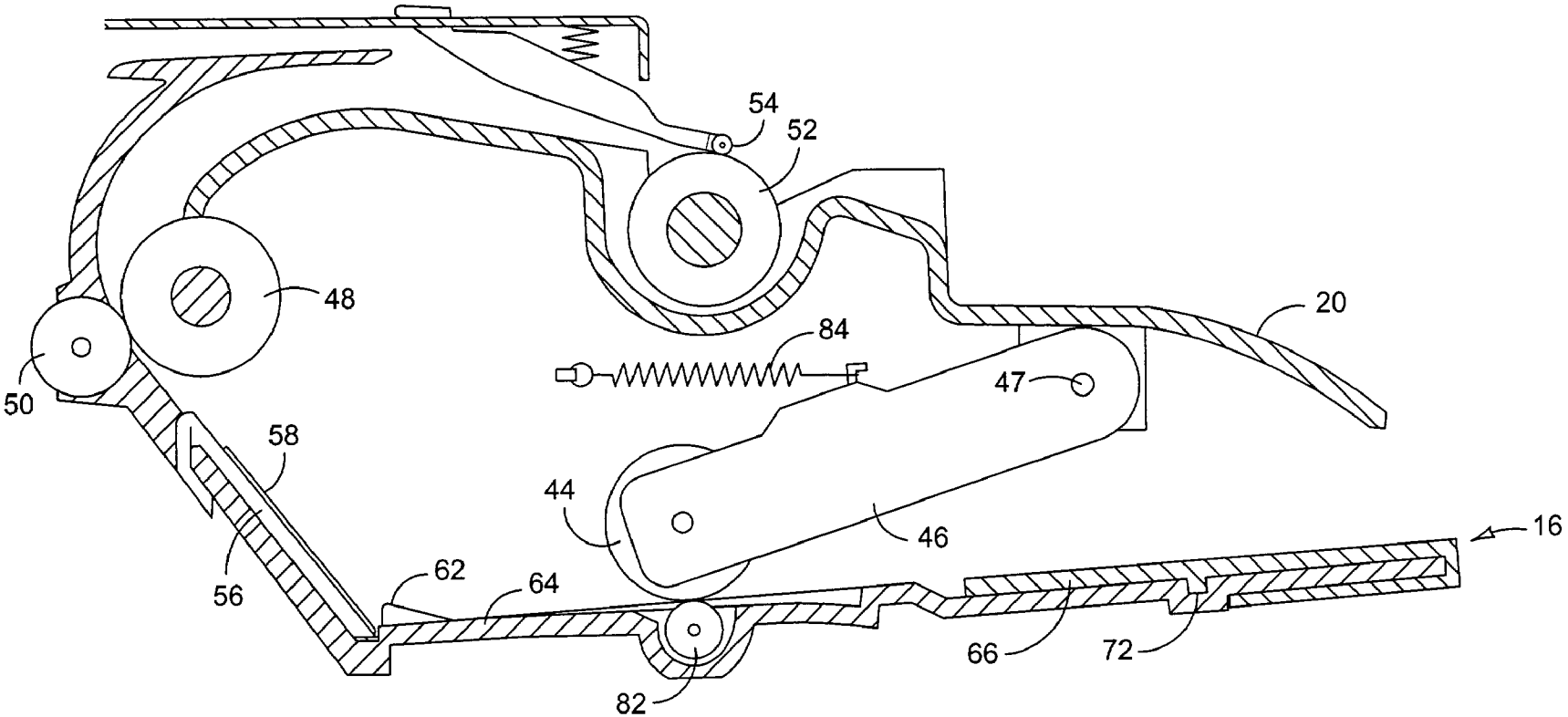
FIG. 6 (Prior Art)

FIG. 4 is a perspective view of the forward part of a conventional input tray 16 and components of the media sheet pick mechanism. FIGS. 5 and 6 are side elevation and partial section views showing conventional tray 16 and pick/feed mechanism components along media path 30. FIG. 5 shows a stack 42 of media sheets 32 in tray 16 and a top sheet being fed along media path 30. In FIG. 6, tray 16 is empty. Referring first to FIGS. 4 and 5, top sheet 32 is "picked" from a stack 42 of media sheets in tray 16 and fed along media path 30. A pick roller 44, mounted on a swing arm 46, rests on top sheet 32. When a sheet is needed for printing, pick roller 44 is driven clockwise at the direction of controller 38 to grab top sheet 32 and feed it along media path 30 toward transport roller 48. Transport roller 48 bears against idler roller 50 to form a nip that moves sheet 32 along toward output roller 52. Output roller 52 bears against idler arm 54 to form a nip that moves sheet 32 onto sheet output supporting surface 20.

Each sheet 32 is guided from tray 16 toward transport roller 48 along guide ramps 56. One or more guide ramps 56 are fitted with a separator pad 58. Separator pad 58 is typically constructed as an elastomeric strip that protrudes from the face of ramp 56. Separator pad 58 resists the forward motion of sheets in the stack 42. The force of pick roller 44 on top sheet 32 is sufficient to overcome the resistance of separator pad 58 while the next to top sheet 60, which is dragged along with only a much smaller sheet-to-sheet friction force, is stopped by pad 58. That is to say, pad 58 separates next to top sheet 60 from top sheet 32. A stack ramp 62 is also sometimes provided to elevate the leading edge of sheets in the stack 42 to reduce the force need to feed top sheet 32 past separator pad 58.

Media tray 16 includes a base panel 64 extending between sidewalls 66 and 68. Media tray 16 typically includes a mechanism to adjust the width of the tray to accommodate different width media. In the printer 10 illustrated in the figures, left sidewall 66 is integral to a slider 70 that slides along a slot 72 in a recess 74 in base panel 64 to adjust for differing width media. Base panel 64 and slider 70 define media support surfaces 76, 78 and 80.

Swing arm 46 is mounted to chassis 22 at a swing arm pivot 47 located upstream and above pick roller 44 such that pick roller 44 swings down counter-clockwise against stack 42. An idler roller 82 is recessed into base panel 64 directly below pick roller 44. When tray 16 is empty, pick roller 44 rests on idler roller 82 as shown in FIG. 6. In the event pick roller 44 is activated when tray 16 is empty, pick roller 44 will turn on idler roller 82 and, therefore, avoid any damage to pick roller 44 or other pick mechanism components.

One advantage of a swing arm type pick mechanism, such as the one shown in the figures, is the self-adjusting relationship between the pick load and the pick force. The swing arm pivot 47 above and behind the contact point between pick roller 44 and top sheet 32 allows the pick force exerted by pick roller 44 to increase automatically as the pick load (the top sheet's resistance to movement) increases. For example, heavier media increases the resistance to movement of top sheet 32. Heavy media, therefore, creates a higher pick load. Consequently, a larger pick force is necessary to move top sheet 32 off stack 42. As the pick load increases, however, the force of pick roller 44 against the unmoving top sheet drives swing arm 46 down and presses pick roller 44 harder against stack 42 to automatically increase the pick force. This effect becomes more pronounced as stack 42 gets smaller and swing arm 46 swings further down because more of the pick force is applied as a pivoting force to drive swing arm 46 down and press pick roller 44 even harder against stack 42. A biasing spring 84 urges swing arm 46 down to maintain contact between pick roller 44 and top sheet 32 in stack 42.

Unfortunately, as pick roller 44 presses harder against stack 42, the friction between the sheets increases which, in turn, increases the pick load. The increased pick load negates some of the self-adjusting effect of the swing arm pick mechanism. The present invention was developed in an effort to reduce the pick load, particularly for heavy, stiff and other higher friction print media.

Carriage 24 and printheads 28 along with other hardware components necessary to deliver ink to the print media are referred to collectively as print engine 83. Rollers 44/82, 48/50 and 52/54 along with other hardware components necessary to transport the print media through printer 10 are referred to collectively as pick/feed mechanism 85. Controller 38 includes the programming, processor and associated memory and electronic circuitry necessary to control print engine 83 and pick/feed mechanism 85. The components of printer 10 described above are all conventional components well known to those skilled in the art of inkjet printing. Therefore, additional structural and operational details of these components are omitted except as noted below for tray 16 and pick/feed mechanism 85.

Figure 7:
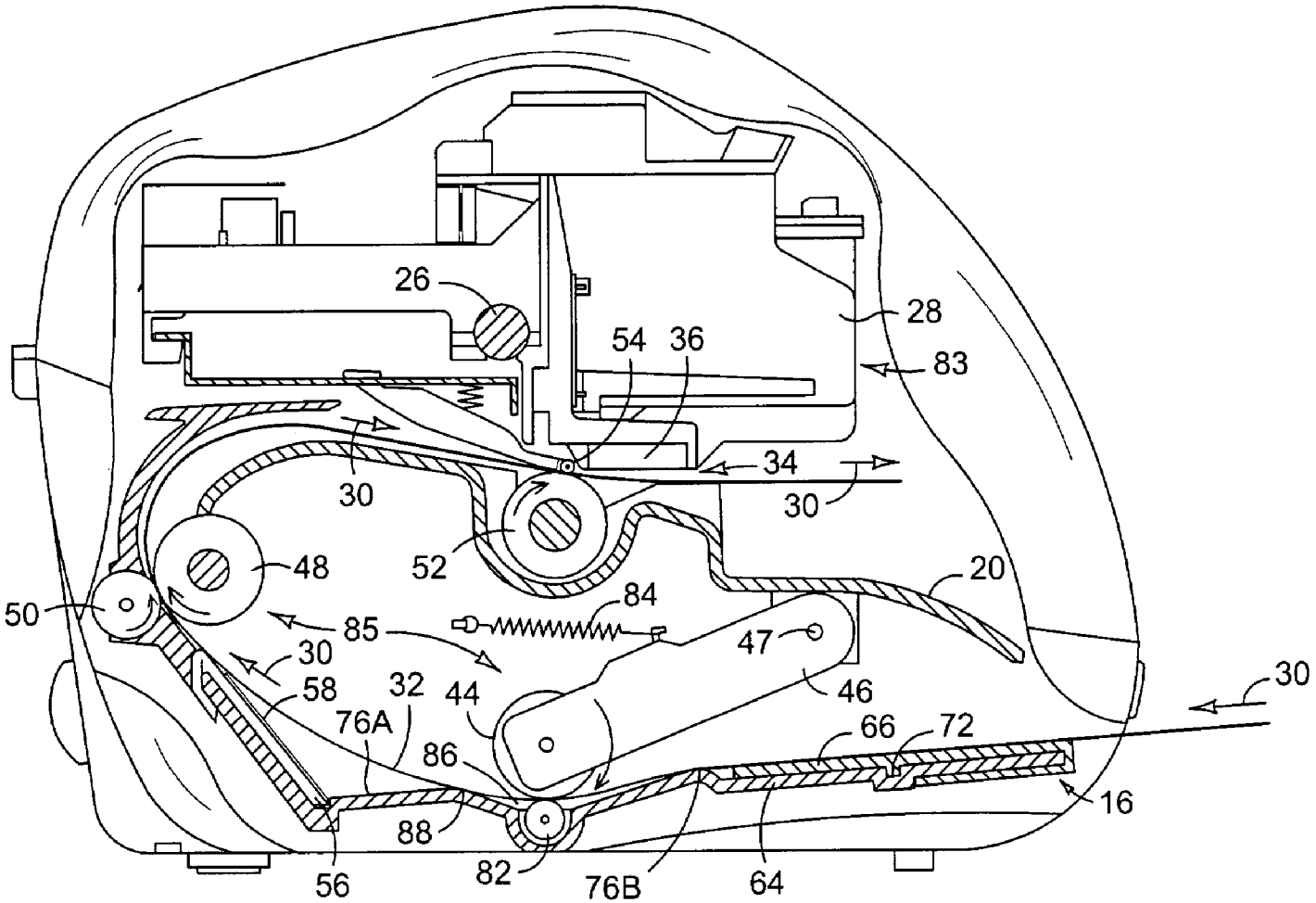
FIG. 7 is a side elevation and partial section view of an inkjet printer such as the one shown in FIG. 2 with a media tray and pick mechanism constructed according to one embodiment of the invention.
Figure 8:
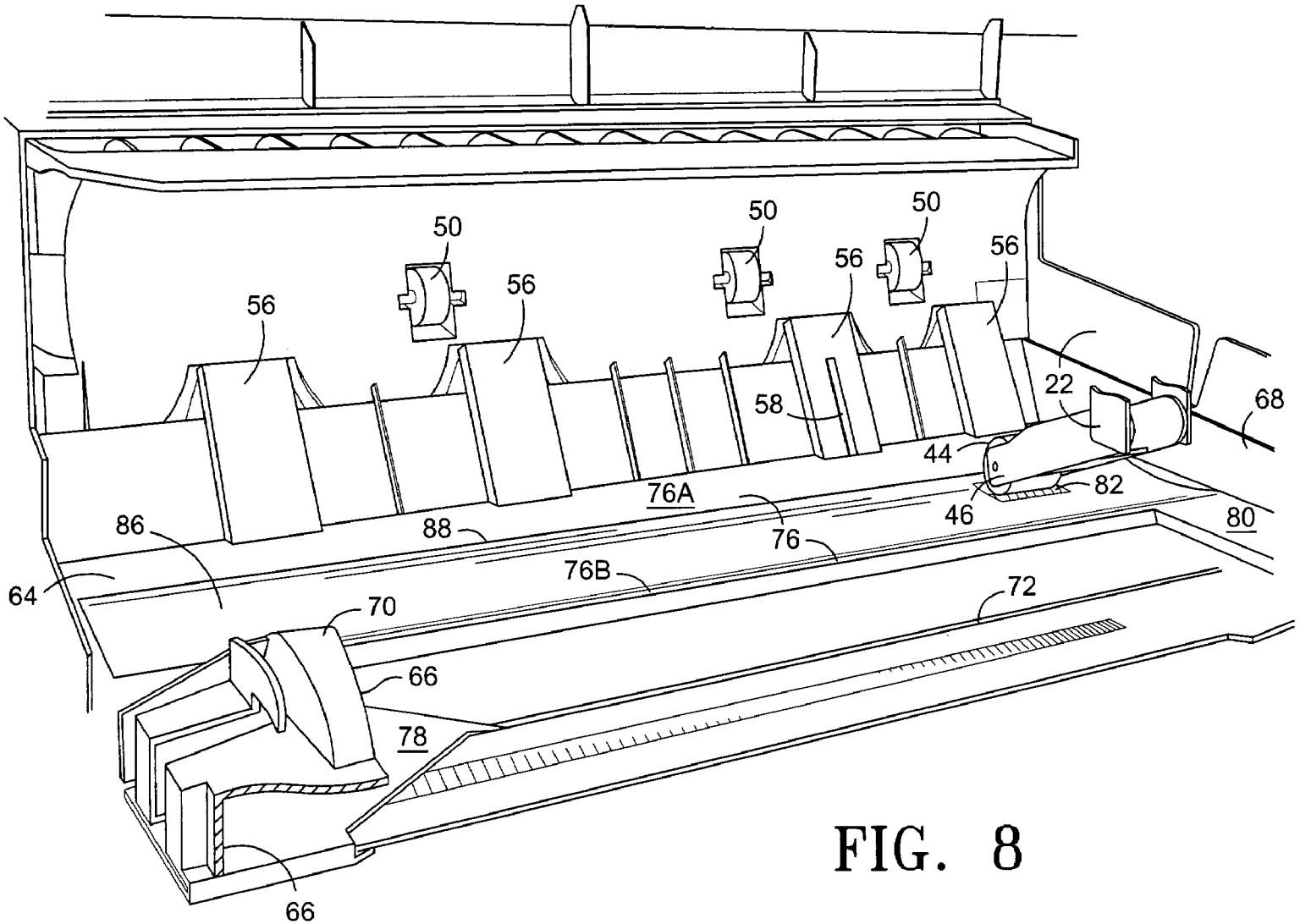
FIG. 8 is a perspective view showing the media tray and pick mechanism of FIG. 7.
Figure 9:
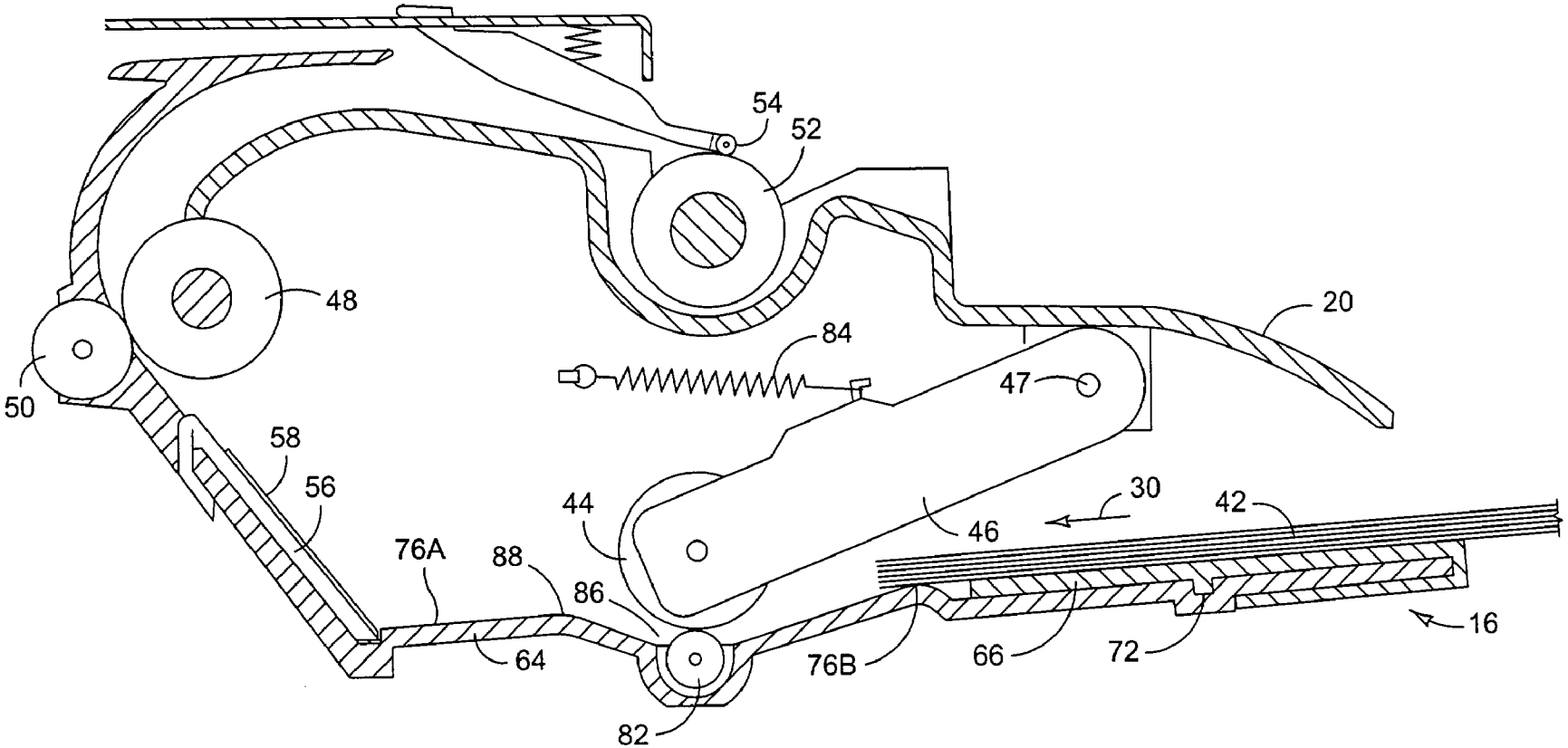
FIGS. 9–11 are side elevation and partial section views showing in sequence the operation of the media tray and pick mechanism of FIGS. 7 and 8.
Figure 10:
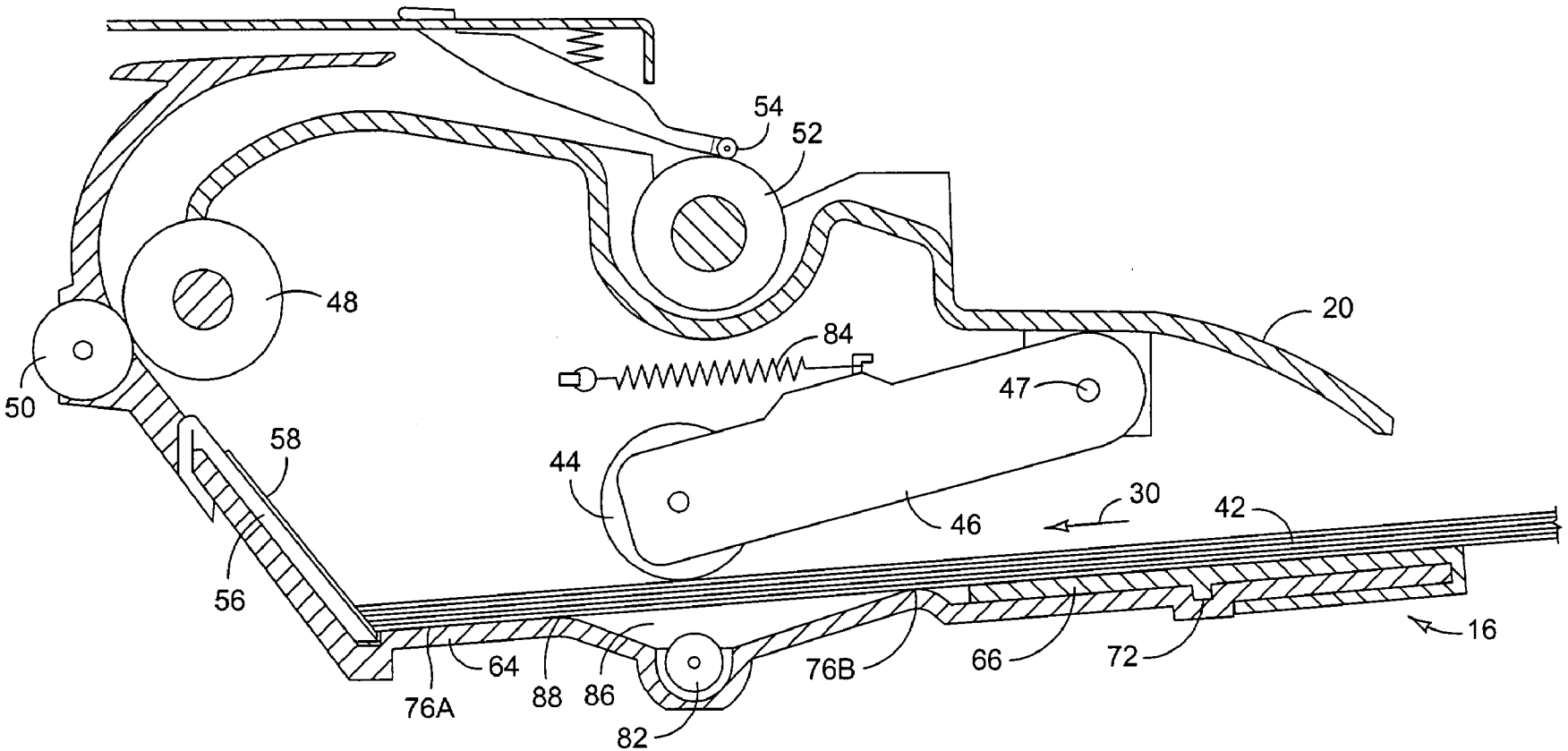
Figure 11:
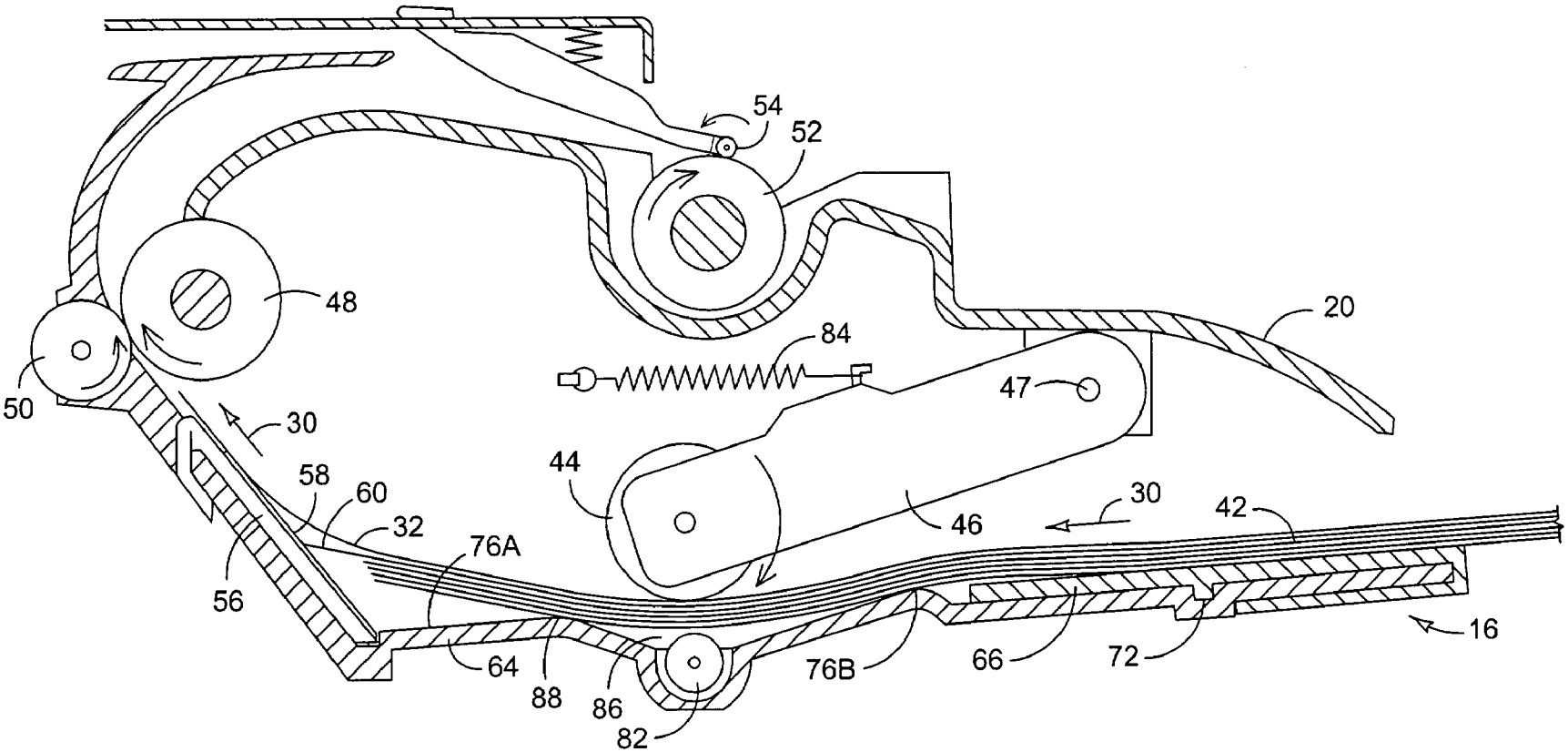

One embodiment of the invention will now be described with reference to FIGS. 7–11. FIG. 7 is a side elevation and partial section view of a printer 10 incorporating a media tray 16 constructed according to a first embodiment of the invention. FIG. 8 is perspective view of tray 16 and components of the media sheet pick mechanism. FIGS. 9–11 are side elevation and partial section views showing in sequence the operation of media tray 16 and pick mechanism of FIGS. 7 and 8.

Referring first to FIGS. 7 and 8, a depression 86 is formed in base panel 64 under pick roller 44 across the full width of media support surface 76. Idler roller 82 is recessed into the bottom of depression 86 directly below pick roller 44. Depression 86, as a feature of base panel 64, represents a discontinuity that divides forward media support surface 76, as another feature of base panel 64, into parts 76A and 76B.

FIGS. 9 and 10 show media stack 42 being added to an empty tray 16. The leading edge of stack 42 pushes pick roller 44 up onto the top of stack 42 as stack 42 passes over depression 86. Separator pad 58 blocks stack 42 at the front of tray 16 and helps prevent the user from pushing stack 42 too far into printer 10. As shown in FIG. 10, the forward part of stack 42 rests on surfaces 76A and 76B and spans depression 86 when the pick mechanism is not operating. Referring to FIG. 11, as pick roller 44 is driven to pick top sheet 32, depression 86 allows the normal force pressing down on stack 42 to deflect stack 42. As stack 42 is deflected into depression 86, the forward edge 88 of depression 86 acts as a fulcrum to raise the leading edge of media sheets in stack 42 more into alignment with media path 30.

Deflecting or bending the media sheets in this way has several advantages. First, the leading edge of each sheet is released from immediate contact with separator pad 58 to reduce resistance to movement. Second, the leading edge of the sheets are more closely aligned with media path 30. Third, each sheet bends a bit differently from adjacent sheets, reducing sheet-to-sheet contact and friction. For top media sheet 32, the degree and duration of release depends on the media's resistance to movement. As top sheet 32 bends and is released from contact with separator pad 58, the sheet has less resistance to movement. Eventually, pick roller 44 will overcome this resistance and feed top sheet 32 into and up along separator pad 58 toward transport roller 48.

When tray 16 is full and stack 42 is high, the normal force pressing down on stack 42 is low and stack 42 does not deflect or bend, at least not much. As stack 42 gets smaller and smaller and swing arm 46 swings down to press pick roller 44 harder against stack 42, stack 42 bends more and more. The media sheet shape change is self-regulating—the greater the normal force pressing down on stack 42, the greater the deflection of stack 42.

Figure 12:
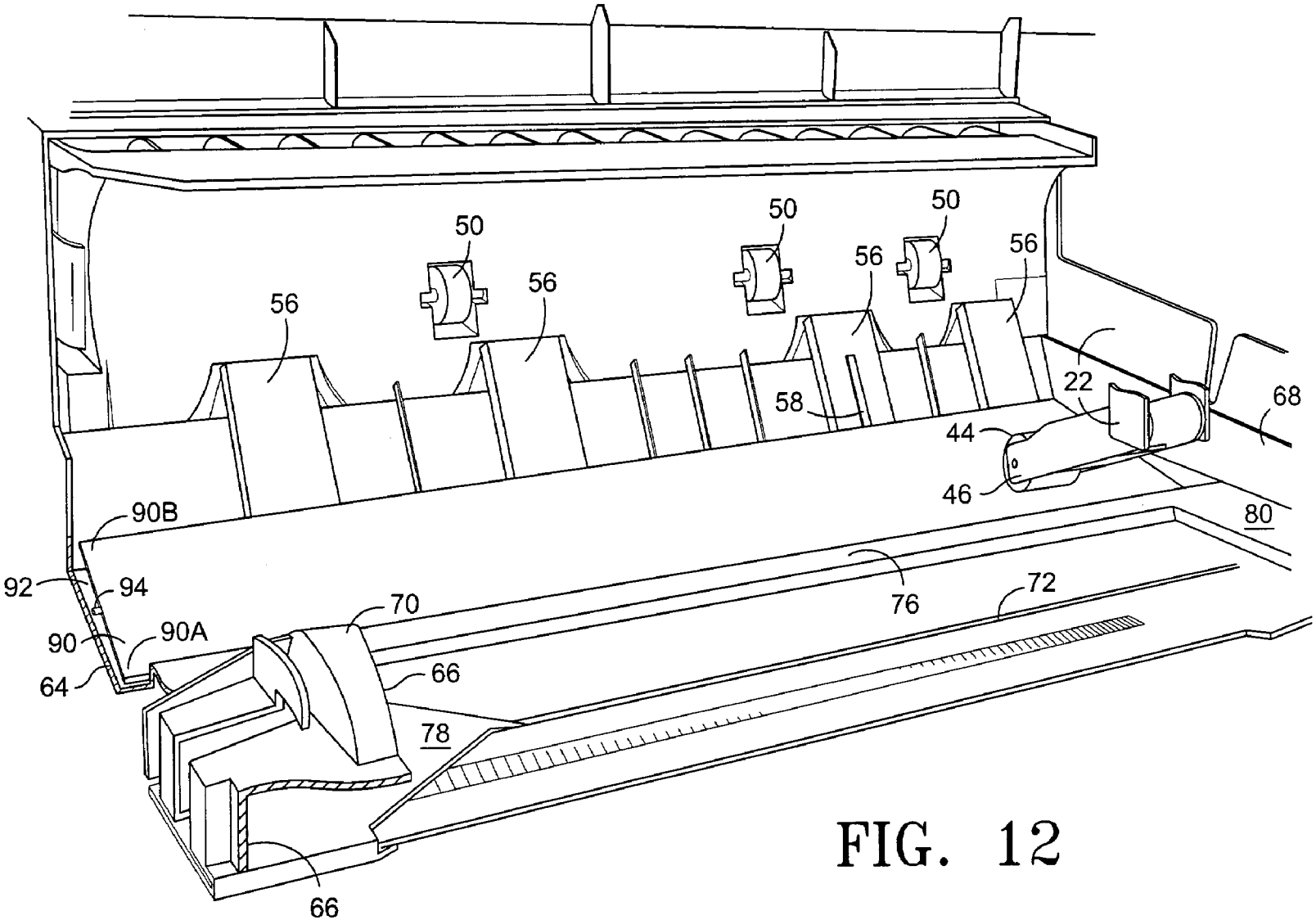
FIG. 12 is a perspective view showing a media tray and pick mechanism according to an alternative embodiment of the invention.
Figure 13:
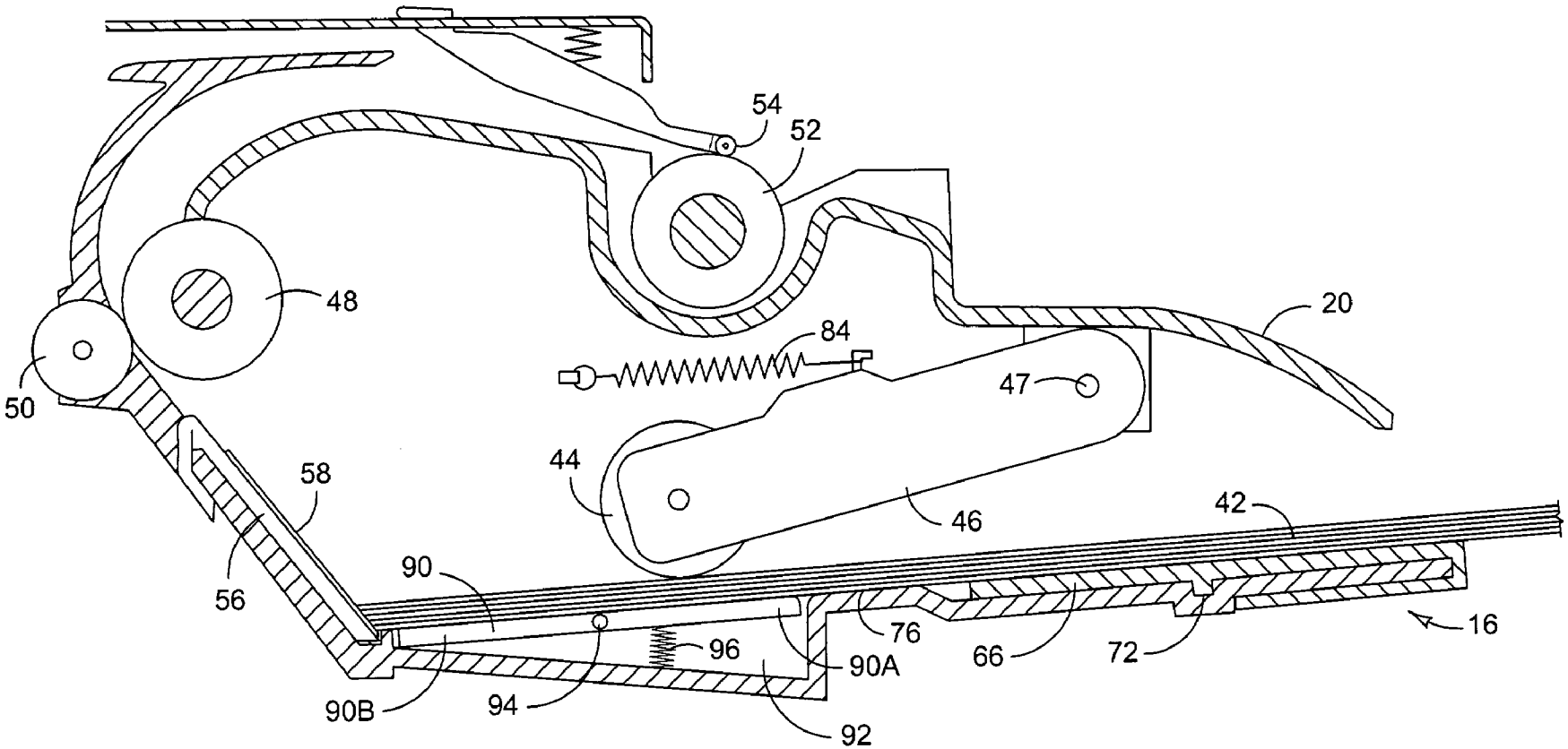
FIGS. 13 and 14 are side elevation and partial section views showing the media tray and pick mechanism of FIG. 12.
Figure 14:
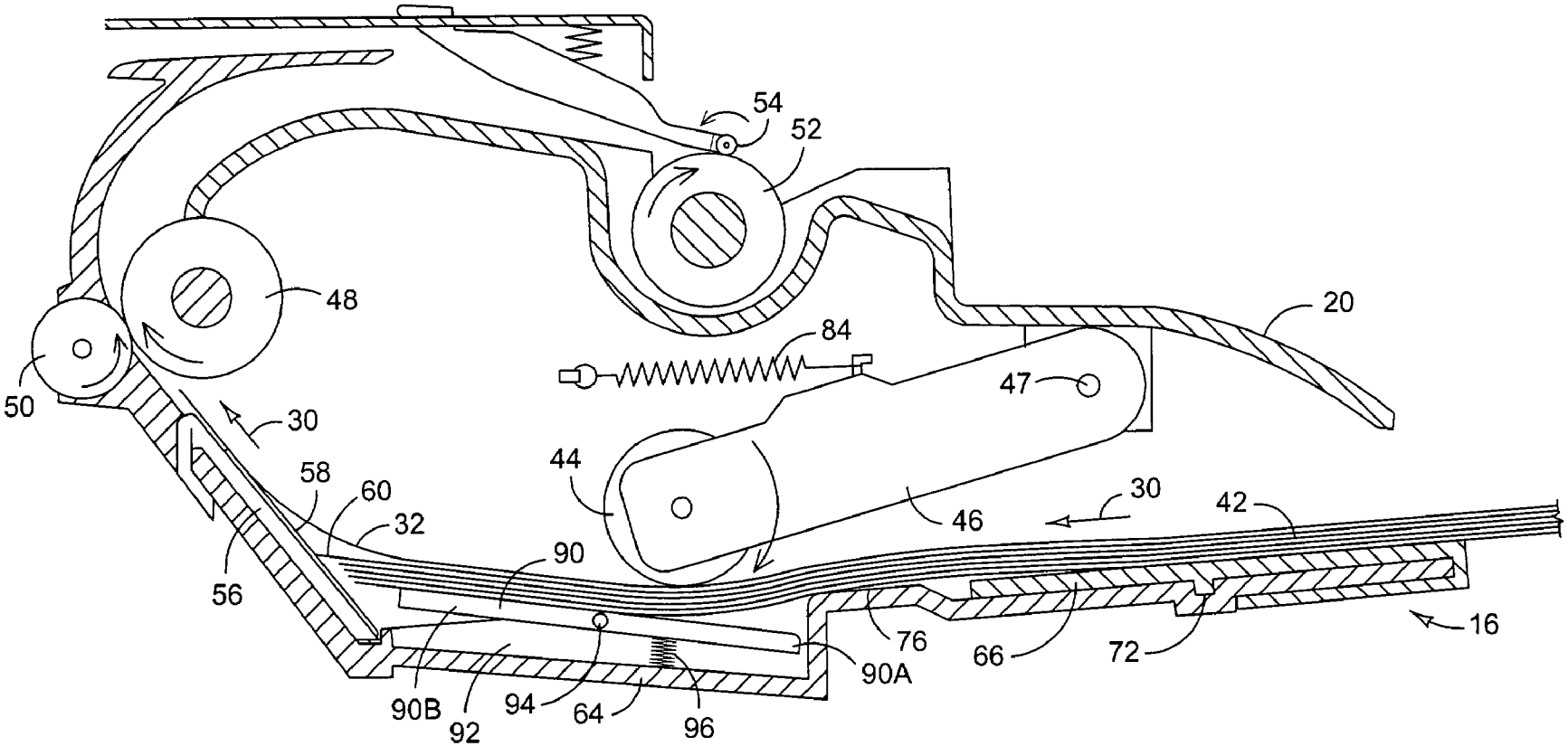

In a second embodiment of the invention, shown in FIGS. 12–14, a pivot plate 90 recessed into base panel 64 is used to more consistently redirect the leading edge of the sheets toward media path 30. Referring to FIGS. 12–14, plate 90 is positioned in a depression 92 in base panel 64 under pick roller 44 across the full width of media support surface 76. Plate 90 pivots on a pin/axis 94. Axis 94 is located forward of pick roller 44 along a middle portion of plate 90. A biasing spring 96 positioned rearward of axis 94 provides enough resistance to generate a normal force sufficient to move top sheet 32 off stack 42 but still allow plate 90 to pivot and redirect the leading edge of the sheets toward media path 30.

When the normal force of pick roller 44 pressing down on stack 42 is high, rear portion 90A of plate 90 is depressed and front portion 90B is raised as plate 90 pivots on axis 94. The movement of plate 90 causes stack 42 to deflect into depression 92 while the leading edge of sheets in stack 42 is raised more into alignment with media path 30. As with the first embodiment, the shape change in stack 42 lowers the resistance of top sheet 32 to the pick force, making it easier for pick roller 44 to feed top sheet 32 along media path 30.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A sheet media input tray, comprising:

a first elevated sheet supporting surface;

a depressed portion immediately adjacent to and downstream along a media path from the first sheet supporting surface, the depressed portion extending across a width of the tray and spanning a full width of sheet media supported in the tray;

a second elevated sheet supporting surface immediately adjacent to and downstream along the media path from the depressed portion, the second sheet supporting surface lying in the same plane as the first sheet supporting surface; and a sheet feeding device over the depressed portion, the sheet feeding device operative to press media sheets into the depressed portion.

2. A sheet media input tray, comprising:

a sheet media supporting surface;

a depression in the sheet media supporting surface, the depression extending across a full width of sheet media supported in the tray; and a pick roller operative to press media sheets into the depression.

3. The tray of claim 2, wherein the depression divides the sheet media supporting surface into a first portion upstream along a media path from the depression and a second portion downstream along the media path from the depression.

4. The tray of claim 2, further comprising a first sidewall positioned along one side of the sheet media supporting surface and a second sidewall positioned along a side of the sheet media supporting surface opposite the first sidewall, wherein the sidewalls define a width of the sheet media supporting surface, and wherein the depression extends across the width of the sheet media supporting surface.

5. The tray of claim 2, wherein the depression defines an elongated fulcrum along which media sheets can bend when pressed into the depression.

6. The tray of claim 2, wherein the depression defines an edge along which media sheets can bend when pressed into the depression.

7. A sheet media pick mechanism, comprising:

a tray for holding sheet media, the tray comprising a base having a first feature configured to support sheet media lying flat in the tray and a second feature intersecting the first feature across the width of the tray, the intersection between the first feature and the second feature defining an elongated fulcrum along which media sheets can bend when pressed against the base;

a swing arm pivotable on an axis located above the tray and upstream along a media path from the second feature of the base;

a pick roller mounted to the swing arm and positioned over the second feature of the base; and an idler roller located in the second feature beneath the pick roller.

8. A sheet media pick mechanism, comprising:

a tray for holding sheet media, the tray comprising a sheet media supporting surface and a depression in the sheet media supporting surface, the depression extending across the sheet media supporting surface such that sheet media held in the tray are supported over the depression across a full width of sheet media supported in the tray;

a swing arm pivotable on an axis located above the tray and upstream along a media path from the depression;

a pick roller mounted to the swing arm and positioned over the depression; and an idler roller located in the depression directly below the pick roller.

9. The mechanism of claim 8, wherein the depression defines an edge along which media sheets can bend when pressed into the depression.

10. A printer, comprising:

a print engine;

a sheet media input tray for holding sheets of print media;

a media path between the input tray and the print engine;

a pick/feed mechanism operative to move media sheets from the input tray to the print engine;

a printer controller configured to control the operation of the print engine and the pick/feed mechanism;

the input tray including a sheet media supporting surface and a depression in the sheet media supporting surface, the depression extending across the sheet media supporting surface such that sheet media held in the tray are supported over the depression across a full width of the sheet media; and the pick/feed mechanism including a swing arm pivotable on an axis positioned above the tray and upstream along the media path from the depression, a pick roller mounted to the swing arm and positioned over the depression, an idler roller located in the depression below the pick roller, and a transport roller positioned downstream in the media path from the input tray.

11. The printer of claim 10, further comprising an elastomeric strip positioned in the media path immediately upstream from the input tray so that a leading edge of each media sheet picked from the input tray and fed to the print engine is pushed along the elastomeric strip before reaching the transport roller.

* * * * *